United States Patent [19]

Garguilo et al.

[11] 4,159,672

[45] Jul. 3, 1979

[54] SCENT PRODUCING APPARATUS FOR FORCED AIR SYSTEM

[76] Inventors: Michael Garguilo, 1812 Westminster Blvd.; Ronald DeVito, 1106 Westminster Blvd., both of Parlin, N.J. 08859

[21] Appl. No.: 846,714

[22] Filed: Oct. 31, 1977

[51] Int. Cl.[2] ..... F24F 7/06

[52] U.S. Cl. ..... 98/30; 126/113; 261/104; 261/107; 261/DIG. 17

[58] Field of Search ..... 98/30, 105, 109; 126/113; 261/DIG. 17, 104, 107; 21/74

[56] References Cited

U.S. PATENT DOCUMENTS

| | | | |
|---|---|---|---|
| 3,119,887 | 1/1964 | Baehr | 126/113 |
| 3,158,081 | 11/1964 | Frost | 98/30 |
| 3,661,323 | 5/1972 | Farris | 98/30 |
| 3,877,459 | 4/1975 | Harvey | 126/113 |

*Primary Examiner*—Henry Jaudon

*Attorney, Agent, or Firm*—McAulay, Fields, Fisher & Goldstein

[57] ABSTRACT

Apparatus is provided for introducing a scent into a forced air temperature changing system of the type having a blower and an air filter positioned upstream of the blower. The apparatus comprises a container for retaining a fluid having the desired scent. A spray device is positioned adjacent the filter and is connected to the system so that the scent containing fluid exiting through the spray device is sprayed onto the filter. A conduit connects the container with the spray device to provide a passage for the flow of the fluid from the container to the spray device. Control means serially connected in the conduit between the container and the spray device controls the flow of the fluid to the spray device. Hence, by operating the control means, the fluid is selectively sprayed on to the filter. The air flowing through the filter picks up the scent and brings the scent to the desired area.

12 Claims, 4 Drawing Figures

SCENT PRODUCING APPARATUS FOR FORCED AIR SYSTEM

BACKGROUND OF THE INVENTION

This invention relates generally to apparatus for producing a scent within a designated area and, more particularly, pertains to apparatus for introducing desired scents into the air entering an area.

In many instances, it is highly desirable to introduce a pleasing scent throughout an entire enclosure such as a house or the like. For example, the cooking of various foods cause unwanted odors to permeate throughout the house and annoy the occupants. Other times, an odor referred to as "house odor" may arise if the house is sealed for a period of time. Alternatively, an occupant may simply desire that a fresh scent permeate the house in view of his particular feelings at that time. In the past, scents have usually been introduced on a per unit basis (i.e., on a room-to-room basis) by uncovering a container having a scent producing liquid therein and placing a wick into the liquid. This is obviously an extremely inefficient way of introducing a scent into the area since it is dependent upon air flow and the rate of evaporation. Additionally, the range of the device is extremely limited.

Other techniques for introducing an airborne scent include the use of spray canisters that the occupant operates by depressing a valve button to permit the fluid carrying the scent to escape. This is a more efficient manner than the former method for quickly introducing a scent into the environment but suffers from the drawbacks that it is extremely expensive and the scent only lasts a relatively short period of time.

Accordingly, an object of the present invention is to provide improved scent producing apparatus.

A more specific object of the invention is to provide scent producing apparatus that quickly and easily introduces a scent throughout an entire enclosure such as a house.

Another object of the invention is the provision of scent producing apparatus that is relatively inexpensive to fabricate.

A further object of the invention is to provide scent producing apparatus wherein respective different scents may be introduced into an enclosure in a simple and effective manner.

Another object of the invention resides in the novel details of construction that provide a scent producing apparatus that is compatible for use with existing forced air heating or cooling systems.

SUMMARY OF THE INVENTION

Accordingly, apparatus for introducing a scent into a forced air system is provided for use in conjunction with a temperature changing system of the type having a blower and an air filter positioned upstream of the blower. The apparatus comprises a container for retaining a fluid having a desired scent. Spray means is adapted to be connected to the system adjacent the filter whereby fluid exiting through the spray means is sprayed on to the filter. A conduit connects the container with the spray means to provide a passage for the flow of the fluid from the container to the spray means. Additionally, control means is serially connected in the conduit between the container and the spray means and is operable to control the flow of fluid to the spray means thereby to control the scent in the air flowing through the filter.

BRIEF DESCRIPTION OF THE DRAWING

Other features and advantages of the present invention will become more apparent from a consideration of the following detailed description when taken in conjunction with the accompanying drawing, in which.

DESCRIPTION OF THE PREFERRED EMBODIMENT

Figure 1:
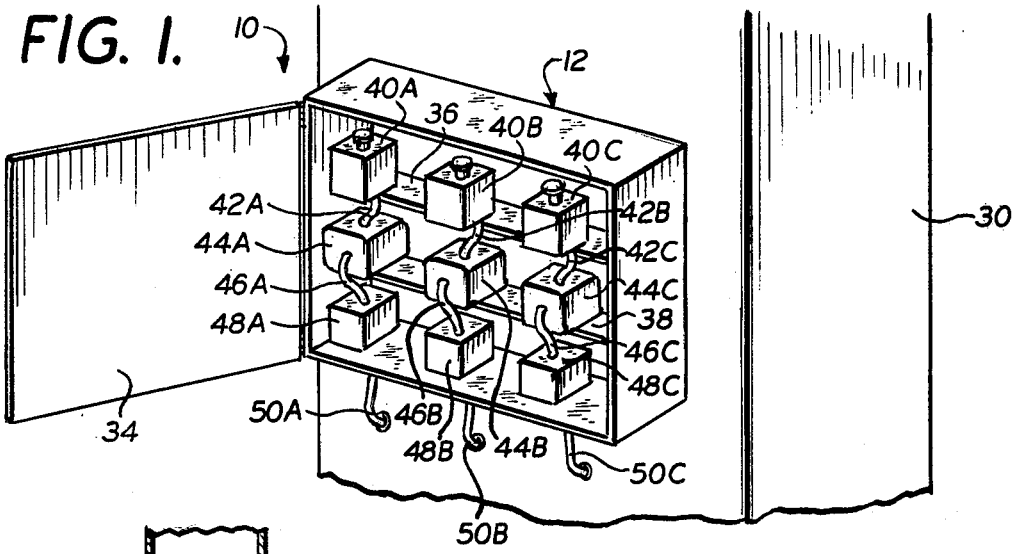
FIG. 1 is a perspective view of the container and the control device of the apparatus of the present invention.

Accordingly, apparatus for introducing a scent into a forced air heating or cooling system is designated generally by the reference character 10 in the FIGS. and comprises a cabinet 12 that is adapted to be mounted on a portion of the forced air system.

To be more specific, the forced air system, which is conventional, may comprise a furnace 14 having an upper chamber 16 and a lower chamber 18. Burners 20 are received in the upper chamber 16 and are adapted to heat the air flowing past the burners. Since the present invention does not reside in the burners per se, the burners are not shown in detail. A duct (not shown) connects the upper chamber 16 with registers and the like which control the flow of air from the upper chamber to the various rooms of a house, for example.

Positioned within the lower chamber 18 is a blower 22. The blowers are usually of the squirrel cage type and are operated by a motor 24 (FIG. 4) which rotates a fan 26. The fan or impeller 26 forces the air within the lower chamber through a conduit which connects with the upper chamber 16 and distributes the air so that the air flows past the burners 20. (As used herein, the term "blower" includes both the impeller and the motor.)

An air return duct 30 provides a path for the flow of air from the rooms in the house to the lower chamber of the furnace 14. To be more specific, an opening 32 is provided in the lower portion of the air return duct and communicates with the lower chamber 18. A bracket 34 is positioned adjacent the opening 32 and receives a filter 36 thereon. The filter may comprise fiberglass wool, interwoven metal straps, etc. which are set within a frame that is supported on the brackets. When the furnace is energized, the blower 22 is operated and the impeller 26 begins to rotate. Air is drawn through the return duct 30 and the filter 36 by means of the blower. The blower then blows this air past the burners and through the room ducts to the various rooms of the house.

Although the above description related to a forced air heating system, it is to be understood that it is also applicable to a cooling system. In other words, the burners may be replaced by the coil of an air conditioning system so that the air is cooled rather than heated. In practice, as is conventional in systems of the type under consideration, an air conditioning unit is located in the plenum chamber of the furnace 14 so that air from the blower must traverse the coils of the air conditioning system. When the system is set for cooling, the air conditioner is operated and the air which is forced past the coil will be cooled by the air conditioning unit before it is forced into the rooms. On the other hand, when heating is called for, the air conditioning portion of the system is disabled and the burners 20 are ignited so that the system forces hot air into the rooms.

In accordance with the present invention, the cabinet 12 is mounted on the return duct 30 by any conventional means such as sheet metal screws or the like. The cabinet is provided with a door 34 that is hingedly connected to the remainder of the cabinet along its rear edge to facilitate opening and closing of the cabinet. Provided within the cabinet are respective vertically spaced shelves 36 and 38. Received on the shelf 36 are respective containers 40A–40C. The containers have removable closures at the tops thereof so that a fluid may be introduced into the respective containers. Each of the fluids associated with a respective container may comprise a fluid that produces a different scent.

Each of the containers is connected by a respective tube 42A–42C to an associated pump 44A–44C. Similarly, a short tube 46A–46C connects each one of the pumps to a respective solenoid operated valve 48A–48C. The pumps are supported on the shelf 38 and the valves are supported on the bottom wall of the cabinet.

Each one of the valves 48A–48C is connected with a respective flexible conduit or tube 50A–50C that extends through the wider walls of the air return duct 30 and terminates within the lower chamber 18 adjacent the filter 36. When installing the apparatus 10, appropriate holes for the conduits 50A–50C may be made in the two opposed faces of the duct 30 and grommets 52 are placed in each one of the openings or holes. The grommets serve two purposes. In the first place, they protect the conduits 50A–50C from the sharp edges of the sheet metal forming the return duct 30. Additionally, the grommets seal the openings around the conduits to prevent air leaks around the respective conduits.

Figure 2:
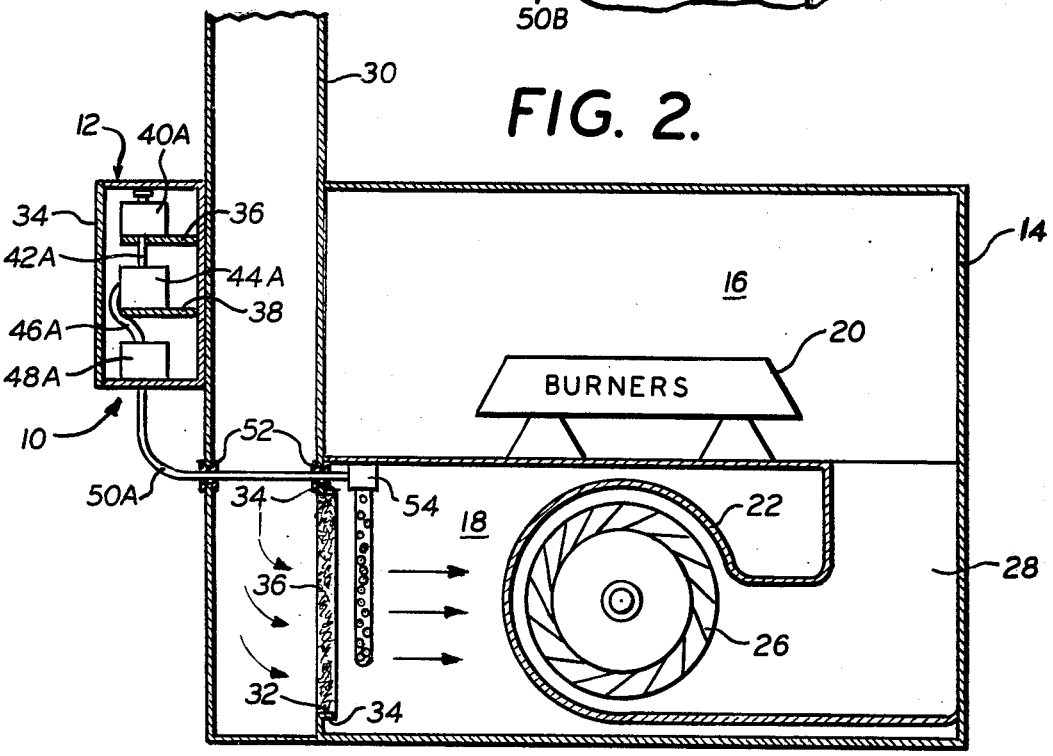
FIG. 2 is a vertical sectional view of a portion of a furnace illustrating the relationship between the apparatus of the present invention and the blower arrangement.
Figure 3:
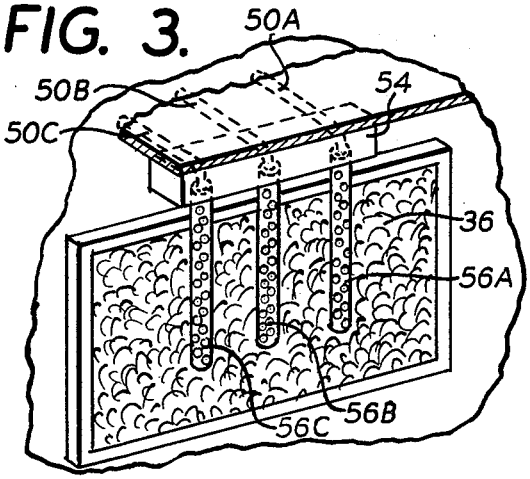
FIG. 3 is a detailed view illustrating the relationship between the spray of the apparatus of the present invention and the furnace filter.

The conduits or tubes 50A–50C extend through an appropriate opening in a bracket 54 (FIGS. 2 and 3) that extends longitudinally within the lower chamber 18. The bracket 54 forms a portion of the apparatus of the present invention and is adapted to be connected to the upper wall of the lower chamber 18 adjacent the filter 36. Depending from the bracket 54 in facing relationship with the filter 36 are respective tubes 56A–56C which are provided with a plurality of through bores on the side of the tube facing the filter. The upper ends of the tubes are connected to the respective conduits 50A–50C. Fluids flowing through the tubes 56A–56C will exit through the through openings and be sprayed upon the filter 36. The tubes effectively, therefore, operate as spray devices which permit the fluids to be sprayed upon the filter.

Figure 4:
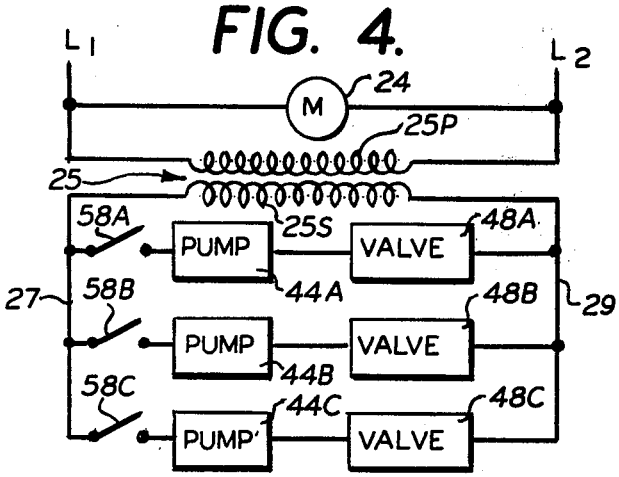
FIG. 4 is a schematic circuit wiring diagram of the control portion of the apparatus of the present invention.

As shown in FIG. 4, the motor 24 that operates the impeller 26 is connected across power lines $L_1$ and $L_2$. As is conventional, power is not applied to the lines $L_1$ and $L_2$ until the thermostat switch closes to call for heating or cooling, as the case may be. In other words, assuming that the area is to be heated, a thermostatic switch is located in the room or area. When the temperature begins to drop and reaches the set point of the thermostat, a circuit is closed whereby the burners 20 are energized and power is applied to the leads $L_1$ and $L_2$ to energize the motor 24 and cause the blower to blow air past the burners into the area to be heated. As the temperature in the area rises due to hot air, the thermostatic switch opens thereby deenergizing the burners and removing power from leads $L_1$ and $L_2$. Since the circuit connections between the thermostatic switch and the motor are conventional, they are not shown in detail.

In accordance with the present invention, a low voltage transformer 25 is provided which has a primary winding 25P connected across the lines $L_1$ and $L_2$. The respective ends of the secondary winding 25S are connected to respective leads 27 and 29. The pump 44A and the associated solenoid operated valve 48A are serially connected between the leads 27 and 29 through a serially connected single-pole single-throw switch 56A. Similarly, the pump 44B and the valve 48B are connected across the leads 27 and 29 through a switch 56B. In a like manner, the pump 44C and the pump 48C are serially connected between the leads 27 and 29 through a serially connected single-pole single-throw switch 56C. In practice the transformer 25 may be a low voltage twelve volt transformer thereby permitting use of miniature valves and pumps. Additionally, the smaller components make for an extremely economical system with low power drain. Although an ac system has been shown herein, it is to be understood that this is for illustrative purposes only and is not to be interpreted as being a limitation of the present invention. That is, a rectifier may be connected in series with the secondary winding 25S and the components may be changed to dc components. For heavy industrial uses, larger pumps and valves may be used which may necessitate use at line voltages.

In operation, the respective switches 58A–58C may be located in the same area as the thermostat (i.e., in the living area) for easy accessability. When it is desired to operate the system, the switches 58A–58C are closed depending upon which scent is desired. Assuming that the scents produced by the fluids in all three containers 40A–40C are desired, all three of the switches 58A–58C are closed so that the pumps 44A–44C and the associated valves 48B–48C are connected across the leads 27 and 29.

When the thermostatic switch closes to energize the motor 24 by applying power to the leads $L_1$ and $L_2$, each one of the pumps and associated valve will likewise be operated. Thus, when the blower is energized, the valve 48A will open (since the valves are in the normally closed position) and the pump 44A will pump fluid within the container 40A through the valve to the tube 56A. The fluid will exit from the openings in the tube and be sprayed on the filter 36. Similar comments apply with respect to the remainder of the valves and pumps so that fluid will also be sprayed on the filter 36 via the tubes 56B and 56C.

Accordingly, the air being drawn through the filter 36 by the blower 22 will pick up the scents from the fluid sprayed on the filter and, as the air is blown through the various duct comprising the air system, the scents will be distributed throughout the house.

If less than all of the scents in the containers are desired, the appropriate switches 58A–58C may be opened to disable the associated valve as desired by the operator. Additionally, the fluids within the containers 40A–40C may be changed in accordance with the desires of the operator so that different scents may be interchanged at different times.

Accordingly, scent producing apparatus has been disclosed which is easily adapted to be connected with existing forced air systems so that scents may be distributed quickly throughout an area in a minimum period of time.

While a preferred embodiment has been shown and disclosed herein, it will become obvious that numerous omissions, changes and additions may be made in such embodiment without departing from the spirit and scope of the present invention. For example, the pumps 40A–40C may be completely eliminated so that the apparatus is of the gravity-fed type. In other words, the fluid would simply pass through the tubes 56A–56C under the influence gravity and pass from the tubes to the filter. Alternatively, the system filter need not be used but some member may be placed in the air system so that the scent carrying fluid can be sprayed on the device.

What is claimed is:

1. Apparatus for automatically and controllably introducing a scent on demand into a forced air temperature changing system of the type having a blower, and an air filter positioned in the air path of said blower; said apparatus comprising:

a container for retaining a fluid having the desired scent; spray means adapted to be connected to said system adjacent the air filter and positioned to direct fluid exiting through said spray means on to the filter; a conduit connecting said container with said spray means to provide a passage for the flow of fluid from said container to said spray means; and manually operable control means serially connected in said conduit between said container and said spray means for controlling the amount and timing of the flow of fluid to said spray means whereby the presence and the apparent strength of the scent added to the air is controllable at will, by the operator.

2. Apparatus as in claim 1, in which said control means comprises a normally closed valve adapted to be selectively opened to provide for the flow of the fluid to said spray means.

3. Apparatus as in claim 2, in which said valve comprises a solenoid operated valve, and lead means for connecting said valve with the blower whereby said valve is adapted to be energized when said blower is energized.

4. Apparatus as in claim 2, in which said control means further comprises a pump adapted to be connected with the blower whereby said pump is adapted to be energized when said blower is energized.

5. Apparatus as in claim 4, in which said valve comprises a solenoid operated valve adapted to be connected to said blower, and a switch for selectively disconnecting said pump and said valve from the blower.

6. Apparatus as in claim 2, in which said spray means comprises a tube having a plurality of openings through which said fluid exits, and a bracket connected to said tube and adapted to be mounted on said system to position said tube adjacent said filter.

7. Apparatus for automatically and controlably introducing a scent on demand into a forced air heating or cooling system of the type comprising an enclosure, a room duct connecting said enclosure with an area to provide a path for air flow from said enclosure to the area, a return duct between said area and said enclosure to provide a path for air flow from said area to said enclosure, a blower within said enclosure adapted to be selectively energized to force air through said room duct and to draw air through said return duct, and a filter for filtering the air blown through said room duct, said apparatus comprising:

a plurality of scent producing devices for providing a desired scent to be carried by the air blown into the area;

each one of said scent producing devices comprising a container adapted to retain a fluid having a desired scent; spray means adapted to be mounted to said enclosure adjacent said filter for spraying the fluid onto said filter; and a conduit connecting said container with said spray means to provide a passage for the flow of fluid from said container to said spray means; and control means serially connected in each of said conduits and, in the presence of an energizing signal, being operable to provide manually selectable individual control of the flow of the fluid from each said container to its said spray means whereby the presence, selection and apparent strength of the scent in the air can be manually controlled.

8. Apparatus as in claim 7, wherein said blower generates said energizing signal when it is energized, and lead means for connecting said control means with said blower whereby said energizing signal is applied to said control means when said blower is energized.

9. Apparatus as in claim 8, and a respective switch for each one of said plurality of scent producing devices for disconnecting the associated control means from the blower.

10. Apparatus as in claim 7, in which said control means comprises a solenoid operated valve.

11. Apparatus as in claim 10, in which said control means further comprises a pump.

12. Apparatus as in claim 7, in which said spray means comprises a tube having a plurality of openings therethrough throughout its length and through which the fluid is adapted to exit, and a bracket adapted to be mounted within said enclosure for supporting and positioning said tubes of each of said plurality of scent producing devices adjacent said filter.

* * * * *